United States Patent [19]

Peleg

[11] Patent Number: 4,841,112

[45] Date of Patent: Jun. 20, 1989

[54] METHOD AND APPLIANCE FOR COOKING A FROZEN POT PIE WITH MICROWAVE ENERGY

[75] Inventor: Yigal Peleg, Solon, Ohio

[73] Assignee: The Stouffer Corporation, Solon, Ohio

[21] Appl. No.: 151,199

[22] Filed: Feb. 1, 1988

[51] Int. Cl.[4] ..... H05B 6/80

[52] U.S. Cl. ..... 219/10.55 E; 219/10.55 F; 219/10.55 M; 426/107; 426/243; 99/DIG. 14

[58] Field of Search ..... 219/10.55 E, 10.55 F, 219/10.55 M; 99/DIG. 14; 426/107, 243, 241, 234, 524

[56] References Cited

U.S. PATENT DOCUMENTS

| | | | |
|---|---|---|---|
| 2,830,162 | 4/1958 | Copson et al. | 219/10.55 E |
| 3,854,023 | 12/1974 | Levinson | 219/10.55 |
| 3,946,188 | 3/1976 | Derby | 219/10.55 |
| 3,965,323 | 6/1976 | Forker, Jr. et al. | 219/10.55 |
| 4,190,757 | 2/1980 | Turpin et al. | 219/10.55 |
| 4,230,924 | 10/1980 | Brastad et al. | 219/10.55 E |
| 4,266,108 | 5/1981 | Anderson et al. | 219/10.55 |
| 4,267,420 | 5/1981 | Brastad | 219/10.55 E |
| 4,398,077 | 8/1983 | Freedman et al. | 219/10.55 |
| 4,453,066 | 6/1984 | Mori | 219/10.55 M |
| 4,454,403 | 6/1984 | Teich et al. | 219/10.55 |
| 4,520,251 | 5/1985 | Yokozeki | 219/10.55 M |
| 4,594,492 | 6/1986 | Maroszek | 219/10.55 E |
| 4,626,641 | 12/1986 | Brown | 219/10.55 E |
| 4,641,005 | 2/1987 | Seiferth | 219/10.55 E |
| 4,656,325 | 4/1987 | Keefer | 219/10.55 E |
| 4,663,506 | 5/1987 | Bowen et al. | 219/10.55 |
| 4,689,458 | 8/1987 | Levendusky et al. | 219/10.55 |
| 4,701,585 | 10/1987 | Stewart | 219/10.55 |
| 4,703,148 | 10/1987 | Nikulski et al. | 219/10.55 |

*Primary Examiner*—Philip H. Leung
*Attorney, Agent, or Firm*—Body, Vickers & Daniels

[57] ABSTRACT

A combination of a mass produced frozen entree type foodstuff, such as a pot pie, formed from a precooked, lossy material filler food having a preselected depth and covered with a layer of uncooked dough and an appliance for transporting and reconstituting this pot pie in a microwave oven wherein the appliance comprises a dish-shaped receptacle formed of a microwave impervious foil material with a cavity for the foodstuff and a peripheral rim whereby the filler material within the cavity is shielded from direct microwave exposure except through the dough layer and a flat, self-sustaining generally rigid microwave susceptor sheet with an outer shape generally matching the preslected shape of the rim on the receptacle wherein the susceptor sheet is supported on the dough in parallel, heat conducting relationship with the upper surface of the dough and is spaced from the rim by the dough. The susceptor sheet includes a thin metallized layer of plastic film laminated to a paperboard. A method of employing this appliance in combination with the pot pie includes passing microwave energy for a preselected time through the dough layer and then into the filler material while the microwave impervious foil material shields the filler material from other microwave energy during which preselected time the filler food is heated and the dough layer is baked and, then, covering the shielded food material with the thin microwave heatable susceptor sheet and passing microwave energy through the susceptor sheet for a time necessary to brown the upper surface of the dough while allowing microwave energy to pass through the dough layer into the shielded filler material.

6 Claims, 5 Drawing Sheets

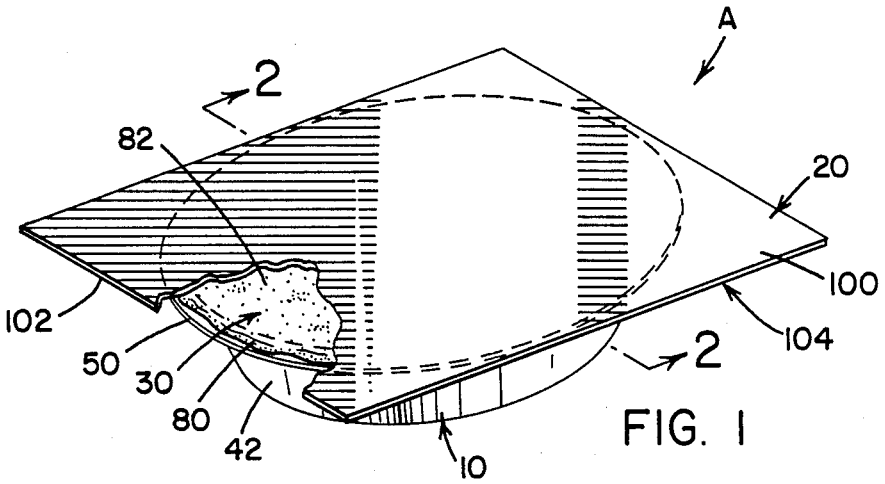
FIG. 1
FIG. 1A
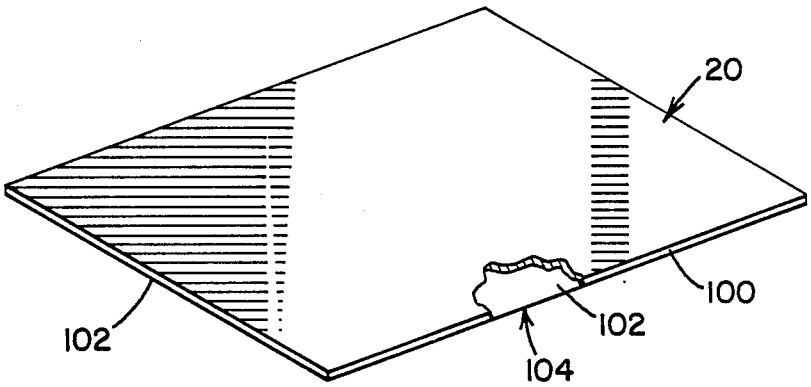

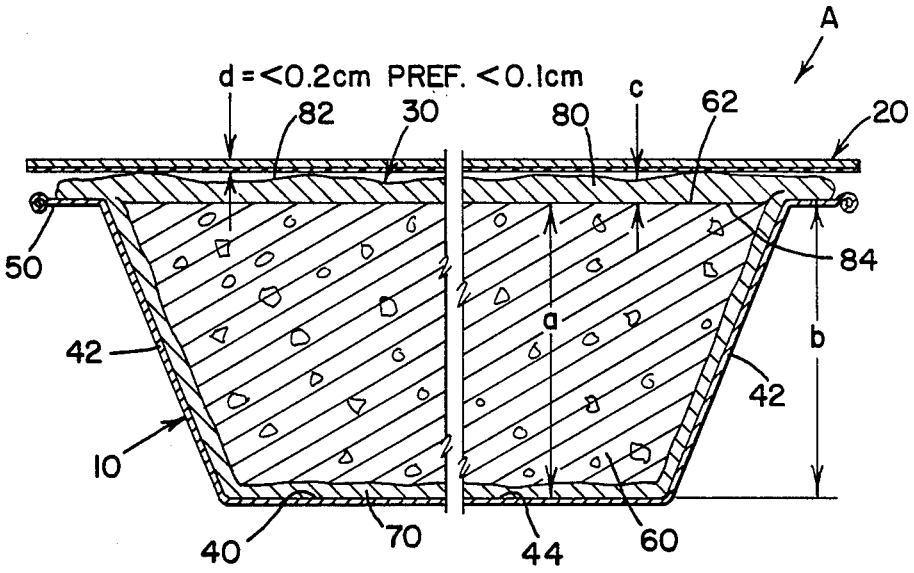
FIG. 2
FIG. 2A
(PREFERRED)
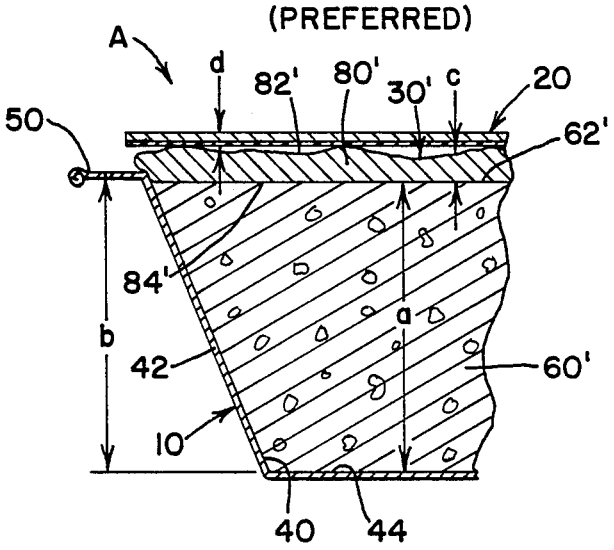

FIG. 3
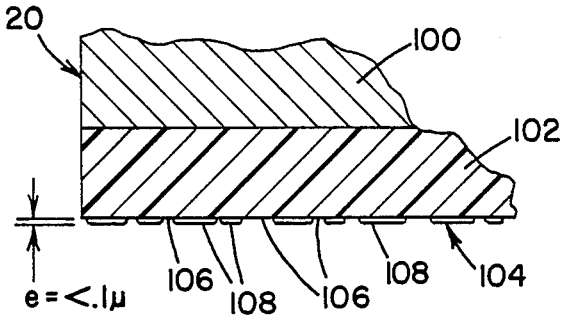
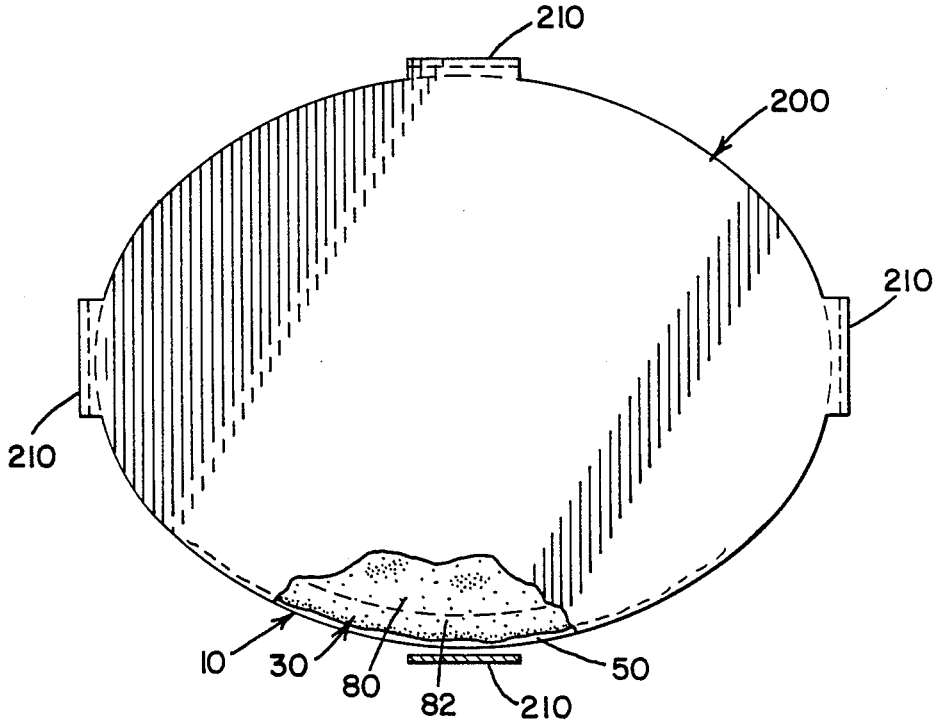
FIG. 4

METHOD AND APPLIANCE FOR COOKING A FROZEN POT PIE WITH MICROWAVE ENERGY

DISCLOSURE

This invention relates to the art of reconstituting a frozen food entree, such as a frozen pot pie, by using microwave energy and more particularly to a combination of the entree, or pot pie, and the appliance or container in which it is transported and reconstituted, together with a method of employing this appliance to reconstitute the frozen entree or pot pie.

INCORPORATION BY REFERENCE

For the purpose of background information, the following United States patents are incorporated by reference herein: Brastad U.S. Pat. Nos. 4,230,924; 4,267,420; Maroszek U.S. Pat. No. 4,594,492; Brown U.S. Pat. No. 4,626,641; Seiferth U.S. Pat. No. 4,641,005; and, Keefer 4,656,325. These patents relate to prior art concepts for incorporating special sheet material with a foodstuff cooked in a microwave oven to assist in the cooking of refrigerated and/or frozen foodstuffs. These patents constitute a portion of the patented prior art for background of the present invention so that details known in the art need not be repeated to understand the present invention and its novelty.

BACKGROUND OF INVENTION

The present invention is directed to a novel combination of an appliance with a frozen food that is topped by dough to allow foodstuffs which must be heated, baked and browned to be processed by a microwave oven without undercooking of the interior food substance and deterioration of the crust into an unappealing, unappetizing heated mass of soggy dough. Heretofore this major problem has been unsolved so that pot pies and, indeed, fruit pies have not generally been available in a frozen condition and yet capable of being reconstituted in a microwave oven in a fashion to produce an appetizing end result. For that reason, pot pies and other frozen pies topped with a dough from quality producers have been packaged and sold in a metal pan which is to be placed into a conventional convection oven. Only in this way was it possible to obtain the desired appearance and taste. This convection cooking requires a substantially long heating time to reconstitute the frozen pie into an acceptable food entree or dessert. With the advent of microwave cooking of frozen foodstuffs and general availability of such ovens, microwave cooking has become overwhelmingly demanded by the consuming public. Consequently, manufacturers of quality pot pies and other crusted food items, or foodstuff, have been seeking an acceptable vehicle for manufacturing frozen pies, transporting them in an inexpensive carton for display at a retail outlet and then for reconstitution by microwave oven in a cooking time drastically less than the time required for baking the pie in a conventional convection oven. So far, these efforts to produce a microwave heatable pot pie in an inexpensive transporting arrangement have generally alluded the manufacturers of pot pies. As an attempt to overcome this problem, some pies have been prebaked so that the crust is browned and then sold in a plastic container which can be heated in a microwave oven. This is nothing more than warming or reheating a previously cooked pie and does not solve the problem and produce the end result of an uncooked pie being baked and browned by a microwave oven. In addition, prebaking or partial baking of the pie tends to cause separation of the crust during shipment and/or reconstitution. Some pies are made with the crust somewhat rigid and spaced from the internal filler food. Others have placed substances on the crust to disguise the failure to bring the crust to the desired cooked condition.

The various patents incorporated by reference herein illustrate the extent to which major manufacturers are attempting to utilize microwave ovens for reconstituting foodstuffs of various type which involve browning and other localized heating. None of these prior art patents, incorporated for background information, teach the novel combination of a pie and appliance in accordance with the present invention; however, certain aspects of these patents are relevant to the background of the invention and these various aspects will be described briefly to illustrate the futility of prior patented concepts in solving the basic problem to which the present invention is directed. This apparent futility is carried over into the marketplace where the problem of cooking pot pies has not been solved.

Brastad U.S. Pat. No. 4,230,924 relates to an early effort to develop a wrapper material to brown the surface of a foodstuff wrapped in the material and employs a concept of converting energy at the wrapping to brown or crispen the particular portion of the foodstuff against which the wrapping is held. The amount of heating is controlled by increasing non-metallic gaps or stripes between metallic islands. The particular technical phenomenon employed in heating the wrapping material is not explained; however, there is an attempt to indicate microwave heating of the wrapper by some conversion of the microwave energy to heat energy. This theory relates to an embodiment of the invention wherein a vacuum evaporation process is employed for depositing aluminum onto a plastic strip supported by a paperboard. This is the general type of material contemplated by the present invention; however, the material is a flexible wrapper and could not be employed in accordance with the present invention. There is no disclosure in this early patent of a pie receptacle using a microwave impervious receptacle for housing the food to be heated and controlling cooking of a pot pie or similar food item.

Bradstad U.S. Pat. No. 4,267,420 relates to a material similar to Brastad U.S. Pat. No. 4,230,924; however, this second patent does not explain the theory of how the aluminum vacuum deposited on the film generates heat at the surface, except for the use of a "myriad" of irregular contoured islands with dielectric channels extending therebetween. To control the amount of browning, the thickness of the metallized coating is apparently changed. This flexible material is employed for "wrapping" material to cook substances, such as fish sticks. The teaching of this patent is not more relevant than Brastad U.S. Pat. No. 4,230,924, except is seems to be more specific on the phenomenon employed in heating a thin metallized surface by microwave to produce heat at the metallized surface of the film. Otherwise it is not relevant to the present invention.

Keefer U.S. Pat. No. 4,656,325 is apparently directed to certain experimental work in Canada, which has resulted in development of a carton having a lower metal ground plane and an upper cover spaced a substantial distance above the foodstuff. This cover has a high dielectric constant and is produced by utilizing relatively large areas of metal material on the outside of the cover. The metal foil is on the outside of the cover and is employed to increase the effective dielectric constant of the cover. This concept is allegedly used to control reflection of microwaves. A relatively large spacing above the foodstuff, in the range of 0.8 to 2.0 cm, is required for the heating system of this patent. This patent includes the concept of a metal foil container in combination with a non-reflecting energy cover having a special design. The cover must be relatively thick or include islands of metal paint or foil. To accomplish the intent of the disclosed invention of this prior patent, metal is required at what is referred to as the ground plane only. Consequently, Keefer U.S. Pat. No. 4,656,325 relates only to a more efficient manner of heating foodstuff and is not directed toward the concept of browning an upper layer of dough as contemplated by the present invention.

Seiferth U.S. Pat. No. 4,641,005 apparently defines a commercially available susceptor material contemplated for use in the present invention as one component of the novel appliance. This Seiferth patent utilizes susceptor material to construct the carton or container itself. It is not used as a separate and distinct susceptor sheet over the crust material as contemplated in the present invention.

Brown U.S. Pat. No. 3,626,641 combines the material in Seiferth U.S. Pat. No. 4,641,005 with a carton to hold a layer of this material a fixed distance "a" above the crust of a pot pie. Again, spacing is indicated to be critical to produce radiant heating. This concept differs from the present invention wherein the material is laid directly on the crust so that the material creates substantially conductive heating as the crust expands and pushes the susceptor sheet upwardly. Since the same material, as used in the Seiferth patent is employed with the same theory in Brown U.S. Pat. No. 4,626,641, it is assumed that no microwave passes through the heating or crispening means of this patent to heat the inside of the pot pie as the crust is browned, an important feature of the present invention. For that reason, the insert of the Brown patent for holding the plastic pie container includes a lower opening to allow direct microwave heating of the pot pie filling which is not used in the novel appliance of the present invention. This feature of direct heating is completely different than the present invention wherein all heating of the filler is to be accomplished by microwave penetration of the crust to bake the crust for browning. This cooking concept is a feature of the present invention and is not taught by Brown U.S. Pat. No. 4,626,641. The spacing of the susceptor sheet is fixed by employing a carton; therefore, heating of the crust is uneven as the crust expands. This spacing variation is proportional to the square of distance above the crust. In accordance with the present invention, by placing the susceptor, as one element of the novel cooking appliance, directly on the crust, uniform conduction heating occurs as the crust rises due to baking by the penetrating microwave energy. Consequently, the appliance of the present invention heats the crust uniformly while the susceptor is being employed without constraint of a container or carton.

A spring biased susceptor sheet is taught in Maroszek U.S. Pat. No. 4,594,492. This patent relates to the use of a susceptor forced against the upper surface of a food in a carton or container to be heated by microwave. This patent also teaches the concept of partially shielding the foodstuff to limit the amount of microwave heating of material in the package itself. There is no suggestion of discarding the carton and using a single susceptor sheet resting upon the upper surface of the crust of a pot pie in a microwave impervious receptacle for the purposes of heating, baking and browning a pot pie.

At this time, there is no commercially available appliance for reconstituting frozen pot pies to the quality of convection cooking, even in view of the background patents pertinent ones which have been described above. There is a substantial need in the marketplace to produce a commercially acceptable, easily manipulable and inexpensive appliance which can be used for the reconstitution of a pot pie so that pot pies can be converted from convection oven reconstitution to microwave reconstitution without sacrificing quality.

Quality of the cooked product is extremely important to a manufacturer of frozen foods since marketing of a pot pie which does not have high quality after cooking will adversely affect the reputation of the manufacturer for its total product line. Consequently, only a sure, repeatable process is acceptable in the mass marketing field and any minor change to give the needed quality is critical.

THE INVENTION

The present invention provides a heretofore unavailable appliance to reconstitute pot pies, and other frozen foodstuffs, having an upper crust. This invention accomplishes this objective without adopting the teaching or suggestions of the various prior art patents disclosing different bits and pieces of technology attempting to solve a variety of microwave cooking problems with various foods where some teachings are related to the objective of the present invention and some teachings are completely irrelevant to the objective of the present invention.

In accordance with the invention, there is provided a combination of a mass produced frozen entree type foodstuff, such as a pot pie, formed from a precooked loosy material filler food having a preselected depth and covered with a layer of uncooked dough with a preselected nominal thickness between an upper generally undulating surface and a lower surface and an appliance for transporting and reconstituting this foodstuff in a microwave oven. The appliance of this combination includes, as a first component, a dish-shaped receptacle formed of microwave impervious foil material with a foodstuff cavity between a lower wall upon which the filler food is supported and an upper peripherally extending rim with a preselected shape and spaced from the lower wall a distance slightly greater than the preselected depth of the filler material and slightly less than the sum of the preselected depth and the preselected thickness of the dough so that the filler food is within the cavity and is shielded from direct microwave exposure, except through the dough itself. The undulating upper surface of the dough layer is above the rim at least at the rim area of the dish-shaped receptacle. By providing this microwave impervious foil material receptacle for the filler material, microwave energy does not enter the filler material except by penetrating and, thus, baking the dough material to form a crust. By shielding the filler material from microwave energy, only the rays of microwave energy passing through the dough actually heat the internal or filler material of the pot pie. This uses the dough to modulate and reduce the heating effect of the microwave on the filler material as the dough is being baked by absorption of microwave energy. The use of a foil, such as aluminum foil, for a receptacle in a microwave oven is not generally employed since there is some mistaken belief that such foil can cause damage to the tube creating the microwave energy. Consequently, the complete shielding of the filler material to cause heating through the dough for baking the dough with the same rays used to cook the filler material is somewhat unique in itself; however, this feature is only one element of the novel appliance employed in accordance with the present invention. A second element of the novel appliance used in combination with a frozen entree is a self-sustaining, generally rigid microwave susceptor sheet with an outer shape generally matching the preselected shape of the rim defining the outer periphery of the foil receptacle. Generally matching means it covers the dough and does not extend laterally a substantial amount. This susceptor sheet is supported on the dough in a generally heat conducting relationship, instead of a primary radiation mode, with the upper undulating surface of the dough and is spaced from the rim of the receptacle by the thickness of the dough above the rim. This susceptor sheet is constructed of a thin metallized layer on a plastic film laminated to a relatively rigid paperboard with a thickness of the total susceptor sheet being less than 0.2 cm and with the metallized layer having a thickness allowing microwave heating of the thin metal layer to brown the dough into a crust by convection heating to a temperature generally exceeding 200° F., as the filler material is heated by microwave energy passing through the susceptor sheet, through the dough and into the otherwise shielded filler material.

The combination of the totally shielded receptacle for the foodstuff and a sheet which is self-sustainable and can be positioned directly over the crust being heated provides a total appliance which can be shipped in a carton and used to reconstitute a pot pie by a customer using a microwave oven. The carton itself is discarded after the pot pie in the aluminum foil container is removed. Consequently, the extremely disadvantageous concept of heating a pot pie in a carton is avoided. The carton to carry the present invention need not be microwave resistant. Blind heating of a pot pie in a carton which hides the pot pie from view of the customer is a definite disadvantage in the frozen food marketing industry. Consequently, the present invention provides an arrangement for cooking a pot pie from the frozen condition to the baked, browned condition by a microwave without employing some type of special carton, wrapper or tube into which the produce must be inserted. By the novel concept of employing a foil container for totally shielding the pot pie, except at the dough, and an upper susceptor sheet lying on the dough, the pot pies can be reconstituted by a microwave oven in the full view of the customer reconstituting the product. This is a distinct advantage not realized by items on the market before the present invention or described in the prior art patents incorporated by reference herein. By marketing a pot pie with the novel two component appliance of the present invention, the consumer has options heretofore unavailable in reconstituting frozen pot pies and similar food products.

In accordance with a method of utilizing the two component appliance of the present invention, a method of reconstituting a frozen pie formed from a precooked, lossy material filler food having a preselected depth and covered with a layer of uncooked dough with a preselected nominal thickness between an upper undulating surface and a lower surface is provided. This method comprises the steps of passing microwave rays, i.e. energy, for a preselected time through the dough layer and then into the filler material while shielding the filler material from other microwave rays or energy for the preselected time during which the filler material or foodstuff is heated and the dough layer is baked, then, covering the shielded material with a thin microwave heatable susceptor sheet and, then, passing microwave rays or energy through the susceptor sheet for a time necessary to brown the upper surface of the dough while allowing microwave energy to pass through the dough layer into the otherwise shielded filler material. In this manner, in accordance with one method of using the present appliance, the pot pie can be heated for a short period of time by directly exposing the pot pie in the microwave impervious container to microwave energy. All energy passes through the crust before it reaches the filler. This energy starts the baking process for the dough as well as the heating process for the filler material. Thereafter, the susceptor sheet is placed over the top of the dough and the heating process by the microwave energy is continued. This action continues to heat the pot pie by energy passing through the dough only. The browning effect of the susceptor lying directly on the dough causes desirable browning of the dough into a quality crust without the necessity of hiding the pot pie in a carton, tube or receptacle as it is being heated and finally baked with a crisp brown upper surface.

In accordance with this method, it has been found that the time for preliminary heating and final heating with the susceptor sheet can be substantially the same. In practice, heating without the susceptor sheet is for approximately 5.5 minutes at 100% power. With the susceptor sheet applied, heating is continued for approximately 6.5 minutes at 50% power. By raising the susceptor from the surface of the dough, but still supporting it on the surface of the dough, convection heating is somewhat reduced. In this instance, all heating of the filler material is still through the dough which causes baking of the dough into a crust; however, the susceptor sheet which is spaced from the surface of the dough but supported on the dough can be used for the total heating time which may be about 5.5 minutes at 100% power or 6.5 minutes at 50% power. In these examples, heating with the susceptor sheet in place can be increased by approximately 1.0 minutes as a maximum heating time for the method as defined above.

In all instances, the pot pie is contained in a metal foil, microwave impervious container so that the microwaves employed in heating the filler material must pass through the dough. Consequently, the dough is heated in a correlated fashion with the filler material to bake the crust. The relationship can be controlled by the manufacturer. The high temperature generated by the self- sustaining susceptor sheet causes the browning of the upper surface of the crust to impart the desired brown, crisp texture of the crust for the purposes of duplicating normal convection oven results.

The primary object of the present invention is the provision of an inexpensive, disposal appliance or utensil for transporting and reconstituting a pot pie, which appliance, in combination with the pot pie itself, controls the heating and browning of the crust so that the pot pie can be reconstituted in a microwave oven while obtaining results generally associated with a standard convection oven.

Another object of the present invention is the provision of an appliance or utensil, as defined above, which appliance or utensil allows reconstitution of a pot pie or similar crusted product in a microwave oven while the consumer can monitor the progress of the cooking or baking procedure.

Still a further object of the present invention is the provision of an appliance or utensil, as defined above, which appliance or utensil does not require reconstitution of the pot pie or similar food product in a carton or enclosure that is resistant to microwave exposure.

Still a further object of the present invention is the provision of a combination of a pot pie and its cooking appliance or utensil, which combination employs an inexpensive, readily available material while performing an heretofore unobtained cooking process for pot pies and related products.

By using the present invention to obtain the objectives mentioned above and as described with respect to the prior art, aluminum foil is employed to prevent heating of the foodstuff or filler except by energy absorbed from microwaves passing through the upper dough of the pot pie. Passing through the upper dough modulates the amount of absorbed heating of the filler in the pie while also baking the dough into a crust as the microwave energy passes through the dough. Both the dough and the filler material are lossy materials which are heated quite efficiently by microwave energy. The total energy of the microwaves is absorbed by the time the rays reach the lower surface of the container. Substantial microwave energy is not reflected from the lower surface of the receptacle to pass back through the filler material and the dough. Consequently, a vast majority of the heat energy is absorbed by the dough and the filler material without being reflected back up through the dough in the reverse direction.

By providing a susceptor layer or sheet immediately adjacent the upper layer of the dough or crust, the susceptor layer increases in temperature when it is exposed to microwave energy. This causes conductivity of heat directly to the crust upon which the susceptor sheet or material is supported. Consequently, the crust is browned as it is baked by the absorbed energy. Any spacing between the susceptor sheet and the upper surface of the crust upon which the sheet is rested is accomplished by depended tabs. Such spacing is employed for the purpose of modulating and reducing the heat effect on the crust so that the filler is at a serving temperature and the crust is baked at the same time that the crust is perceptibly browned and crisp. Consequently, any spacing of the susceptor sheet from the upper portion of the crust upon which it rests is small and is used to decrease the heating effect at the crust to allow the filler material to obtain a serving temperature at the same time the crust is browned. This process does not contemplate creation of a radiant heating chamber above the foodstuff as obtained by the special cover in Keefer U.S. Pat. No. 4,656,325 wherein an upper space between the food and solid aluminum foil on the special cover concentrate energy in the large space above the foodstuff.

By using the present invention, overcooking of the lossy filler material is prevented so that this material can be heated to the serving temperature as the crust has been baked and browned. When exposing pot pies directly to microwave energy from the side and/or through the bottom, the filler material becomes overcooked long before the crust has been baked and then perceptibly browned. The unique aspect of the present invention is the use of the dough forming the crust for the purpose of modulating the energy to the filler material. This unique action causes a perceived baking prior to browning. However, if this were done without the susceptor sheet, also a component of the present invention, the filler material would be overheated before the dough is baked and browned. The susceptor sheet limits the amount of energy passing through the dough and into the filler material. This fine tuning of the cooking operation by providing a susceptor sheet for limiting the amount of microwave energy available for cooking and for passing this available energy through the dough and, then, into the filler material while no other microwave energy is absorbed by the filler material produces the end result of the present invention. This end result has proven extremely satisfactory for reconstituting chicken pot pies in a microwave oven in less than about 12 minutes.

These and other objects and advantages of the present invention are obtained by the preferred embodiment and certain modifications thereof disclosed in conjunction with the various drawings.

BRIEF DESCRIPTION OF THE DRAWINGS

FIG. 1 is a pictorial view of the preferred embodiment of the present invention showing the two element appliance or utensil for microwave reconstitution of frozen pot pies;

FIG. 1A is a pictorial view of the self sustaining, generally rigid microwave susceptor sheet employed as one component of the appliance or utensil shown in FIG. 1 with a cut away section exposing the lower plastic film;

FIG. 2 is a partial, enlarged cross sectional view taken generally along line 2—2 of FIG. 1;

FIG. 2A is a partial view of the modification for a pot pie or a crusted food entree showing use of the preferred embodiment of the present invention;

FIG. 3 is an enlarged partially cross sectioned view showing details of the susceptor sheet employed as one component of the appliance or utensil of the present invention;

FIG. 4 is a plan view of a modified microwave susceptor sheet having tabs to space the susceptor sheet from the crust of the pot pie to be cooked with a cut away section showing the pot pie;

PREFERRED EMBODIMENT

Figure 5:
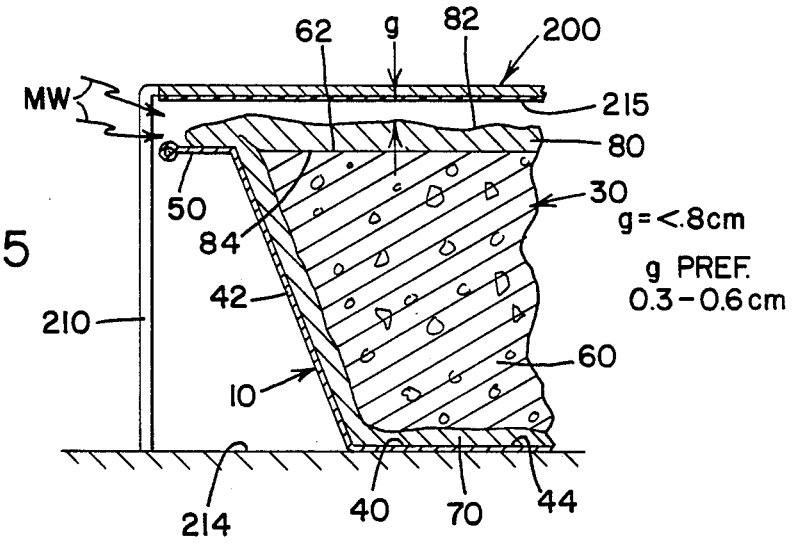
FIG. 5 is an enlarged cross sectional view similar to FIGS. 2 and 2A illustrating the use of the modified susceptor sheet shown in FIG. 4.

Referring now to the drawings wherein the showings are for the purpose of illustrating a preferred embodiment of the invention only and not for the purpose of limiting same, FIG. 1 shows an appliance or utensil A formed from an aluminum tray or receptacle 10 and a microwave susceptor sheet 20 for the purposes of encapsulating a pot pie 30 as best shown in FIG. 2, the aluminum tray or receptacle 10 is formed from aluminum foil and includes a normal food cavity 40 having generally divergent sidewalls 42 and an upper peripherally extending rim 50. Although postulated that this type of unit could not be employed for microwave heating, it has been found that such trays or receptacles can be placed in a microwave oven without damage to the oven or harmful arcing. In practice, the tray is coated with a nonconductive plastic; however, this is not essential. Pot pie 30 in cavity 40 of receptacle 10 includes a lossy filler material 60 having a top upper surface 62 which is spaced a distance a from the lower surface 44 of receptacle 10. It is observed that in FIG. 2 the top or upper surface 62 of the filler material is below rim 50 so that microwave energy can not pass into the filler material from the sides or the bottom. Tray or receptacle 10 is impervious to microwaves and is formed from a sufficient layer of aluminum to reflect the microwaves. Consequently, no heating takes place at the aluminum surfaces forming tray 10. In this fashion, the filler is shielded from microwave energy, except from energy entering through the top or open portion of cavity 40. This energy heats the filler material 60 and progresses to the lower dough layer 70, if such a layer is used to encapsulate the pie 30. Generally a frozen pot pie includes only an upper layer of dough 80. This layer has an upper undulating surface 82 and a lower generally flat surface 84. The latter surface is adjacent top surface 62 of filler material 60 to generally close any space or void at this area of the pie. The upper surface is indicated to be undulating where the lower surface may be undulating, but is considered to be flat in that it interfaces with the upper or top surface 62 of filler material 60. Over the upper undulating surface 82 of dough layer 80 the rigid self sustaining generally flat microwave susceptor sheet 20 is placed to rest upon the dough by mere gravity during the cooking operation. Distance b is the distance from the lower wall 44 to the top of rim 50. This distance b is more than distance a for the shielding purposes previously described. Dough layer 80 has a thickness c which combines with depth a to define the overall height of the dough layer above lower wall 44. This combination is higher than the rim so that susceptor sheet 20 rests upon the crust and above the rim. All microwave energy passing into filler material 60 must pass through the dough. This is clearly illustrated in FIG. 2. The susceptor sheet 20 allows a limited amount of microwave energy which energy is employed for the purposes of heating filler material 60 and baking upper dough 80. This will bake dough layer 70;however, the invention relates to a system for cooking a pot pie shown in FIG. 2A having no lower crust 70.

In accordance with the invention, a layer of metallized aluminum on the under surface of sheet 20 is heated by the microwave energy passing through the sheet to a temperature exceeding about 200° F. This causes heating of the upper surface of dough layer 80 by conduction from the lower surface of sheet 20. As the dough is baked by absorbed energy and rises or falls, the gravity held self-sustaining rigid susceptor sheet follows along the dough so that the browning action is maintained even though the dough may change its size and/or position. Consequently, conductive heating which causes browning and a crisp texture to the upper surface 82 is maintained at an efficient position which is in contact with or supported on the crust formed by baking and browning of upper dough layer 80. By riding on or resting upon the crust, the browning effect can be accomplished in a microwave oven without depending upon any inefficient radiant action. Conduction is accomplished. To reduce the amount of browning while increasing the heating, spacing may be employed between the sheet resting upon the upper dough surface and upper dough surface as will be explained later. As can be seen, the undulating surface 82 does produce certain cavities between flat sheet 20 and the upper surface. This spacing is small enough to be referred to as conduction heating in that there is not an attempt to rely upon radiant heating. Any spacing of the sheet from the crust is for the purpose of allowing more microwave energy from around the sheet to pass directly through the crust or upper dough surface into the filler material 60 during the cooking operation.

FIG. 2A relates to a preferred type of pot pie 30' wherein the filler material 60' has an upper surface 62' covered by dough layer 80' having an upper undulating surface 82' and a lower interface surface 84'. Microwave susceptor sheet 20 having a shape generally matching the shape of the pie as shown in FIGS. 1 and 2, is rested upon surface 82' for the purposes of conduction heating caused by heating of the metallized surface of sheet 20 in contact with surface 82'.

Referring now to FIG. 3, the preferred embodiment of the microwave susceptor sheet 20 is illustrated as including a paperboard sheet 100 having a thickness of about 0.02 inches and a thin plastic layer 102 of less than 0.001 inches. Onto this layer is vacuum deposited a thin layer 104 of aluminum having a thickness e which is less than about 0.1 micron. Thickness d of sheet 10, as illustrated in FIGS. 2 and 2A, is less than 0.2 cm and is preferably less than 0.1 cm. The preferred embodiment has a thickness d of about 0.02 inches. The vacuumized layer 104 is generally illustrated in the patents incorporated by reference herein and includes a thickness providing a surface resistivity in the range of 1–300 Ohm-s/in$^2$. In accordance with another construction of this material, the spacing 106 between aluminum droplets 108 is controlled to allow passage of a preselected amount of radiant energy. In practice, this controlled percentage of microwave passages in the general range of 50–80%. In accordance with the preferred embodiment of the present invention, surface 104 is controlled and tested for the surface resistivity to obtain the desired heating effect at surface 82 in accordance with known practice.

Referring now to FIG. 4, in some instances the susceptor sheet may be spaced a distance g from surface 82 of the layer of dough 80, as shown in FIG. 5. In this instance, susceptor sheet 200 having an outer periphery matching the outer periphery of the pot pie 30, which is shown as oval, includes downwardly foldable tabs 210. These tabs are folded downwardly, as shown in FIG. 5, so that the tabs can rest upon the floor 214 of the oven to create a gap or distance g. In practice, this gap is quite small to still essentially cause conduction heating of surface 82 as previously explained. Often the tabs spread so sheet 200 is supported on rim 50 and layer 82. Spacing more than about 0.8 cm produces radiant heating effect which is difficult to control and changes drastically as the crust changes shape. As previously explained, the susceptor sheet essentially rests upon upper layer 82. By providing gap g, additional microwaves can enter between rim 50 and the lower surface of sheet 200. This causes additional cooking without distracting from the essentially conduction heating of surface 82. The layer 214 on the under surface of susceptor sheet 200 is provided with the aluminum surface as previously described. That surface includes a surface resistivity in the range of 1–300 Ohms/in$^2$. Preferably, the surface resistivity is in the range of 1.5 Ohms/in$^2$. The higher the resistance, the higher the temperature; therefore, when the susceptor sheet 200 is raised to produce the gap g, higher surface resistivity may be used. The gap g is in the range of 0.3–0.6 cm and less than 0.8 cm, as indicated in FIG. 5. This is a relatively small spacing and essentially maintains a conductive relationship between the layer of metal or sheet 200 which becomes heated by microwave energy and the upper surface to be browned. Clearly spacing g is such a small magnitude that direct radiation occurs if radiation is employed; however, conductive heating is anticipated. In practice tabs 210 spread outwardly and rest upon rim 50 instead of floor 214. Thus, the length of the tabs defines the maximum gap g within the limits on FIG. 5.

Figure 6:
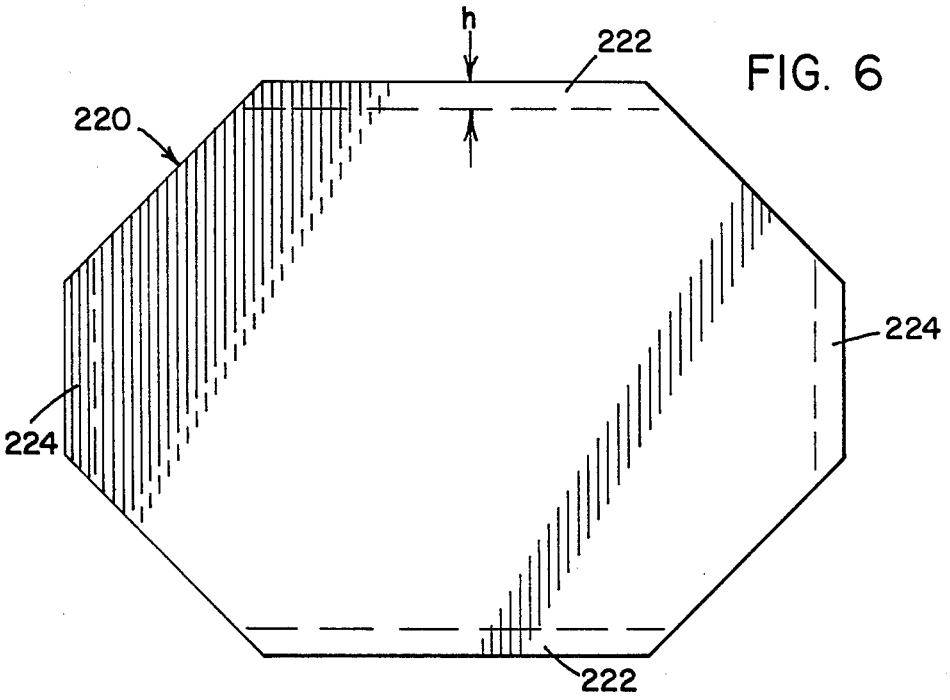
FIG. 6 is a bottom plan view of a modification of the susceptor sheet as shown in FIG. 4.
Figure 7:
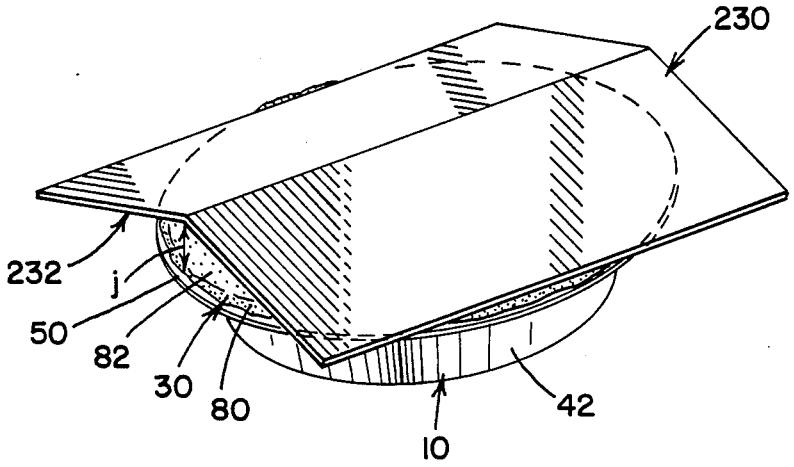
FIG. 7 is a further embodiment of a susceptor sheet that is not preferred, but may be used in accordance with the present invention; and, FIG. 8 is an enlarged section of the susceptor sheet employed in accordance with the present invention with a modification to control or modulate the amount of microwave energy passing through the susceptor sheet during the cooking operation.

Referring now to FIG. 6, susceptor sheet 220 includes fold down tabs 222 and 224 which have a width h generally matching the width c plus the relatively gap g. In FIGURE 7, a tent- shaped susceptor sheet 230 is illustrated wherein the susceptor sheet has the susceptor or metallized inner surface 232 on the inner surface facing upper surface 82 of the pot pie 30 in receptacle or tray 10. This embodiment of the invention allows more microwave heating during the cooking operation. The height j from the apex of the tentshaped configuration to surface 82 is approximately 0.5 inches. This still maintains the browning effect on the upper surface so long as tray 10 shields the total pot pie from microwave heating, except by microwave energy which is first absorbed by the dough layer and then transmitted into the filler. This particular embodiment is not a preferred embodiment of the invention but has been tested and proved to be successful in operation.

Figure 8:
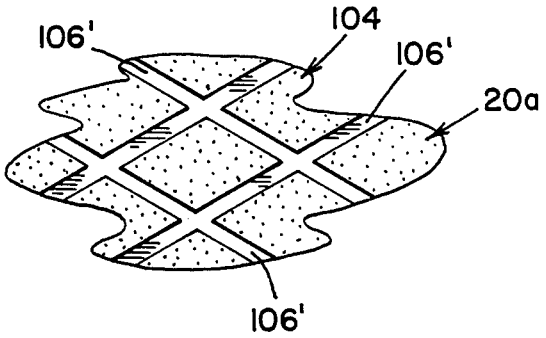

Referring now to FIG. 8, a section of a modified susceptor sheet **20*a* is illustrated wherein metallized layer 104 is provided with masked nonmetallized strips 106'. The width and number of these strips as compared to the total surface area of sheet 20*a* determines the amount of microwave energy allowed to pass freely through layer 104 for the purpose of increasing the amount of microwave heating through the dough and into the filler material. In this instance, the relationship between the area of strips 106' and surface 104 allows passage of 50–80% of the microwave energy. Again, this is an embodiment of the invention and not the preferred embodiment as explained in connection with FIGS. 1–7 and which have proven successful. It is also contemplated that the amount of microwaves passing through sheet 20' could be controlled by masking through a photoresist process to produce the desired amount of area not covered by the surface 104**.

EXAMPLES

A Stouffer chicken pot pie was reconstituted in an oven for 40–45 minutes at 400° F. as a standard against which the invention was equated. The pot pie was cooked and the crust had a fully baked condition with a variation between a light brown and a dark brown on the crust. Utilizing a flat susceptor sheet as shown in FIG. 1A, a duplicate of the standard pot pie was heated in a conventional microwave oven for 5.5 minutes at 100% power without the susceptor sheet. Thereafter, the susceptor sheet was laid over the baked crust and the microwave oven was energized at 50% power for 6.5 minutes. The end result was a brown and reconstituted pot pie generally equivalent to the convection oven pot pie.

A further standard pot pie was provided with a raised susceptor sheet, as shown in FIG. 6. This susceptor sheet was laid over the top surface 82 of the pot pie. With the susceptor sheet in place, the microwave oven was operated at 100% power for 5.0 minutes. Thereafter, the microwave oven was operated for 6.5 minutes at 50% power with the raised susceptor sheet, or spaced susceptor sheet, in place. This pot pie was reconstituted in a fashion comparable in appearance and quality to the conventional oven.

To determine the maximum heating of these examples, the test was repeated using a flat susceptor which was laid on surface 82 and was subjected to microwave energy of an oven set to 50% power for 7.5 minutes. This process produced a browner and more crisp surface 82; however, it was still acceptable. The raised susceptor test was increased from 5.5 minutes at the 100% power level to 6.0 minutes at the 100% power level. This produced additional browning; however, it produced satisfactory results.

Another test was conducted with the tent-shaped susceptor sheet 230 as shown in FIG. 7. This sheet had a spacing of about 0.5 inches at its apex and the pot pie of the same type discussed above was heated for 8.0 minutes at 100% power level. The end result was successful and was somewhat advantageous in that a lower heating cycle was required without changing the microwave setting. By employing the present invention, the tray 10 is removed from the carton and heated in a microwave oven. Placing the susceptor sheet over the pot pie allows visual observation by the operator as well as some control by the operator as to the cooking procedure. Such control is generally a marketing advantage and, in this invention, results in a superior baking cycle for a food product having an upper crust.

Having thus defined the invention, the following is claimed:

1. A combined frozen pie and appliance for reconstituting the frozen pie in a microwave oven by direct exposure to microwave energy with said frozen pie being free of any transporting carton, said pie including a precooked, lossy material filler food having a preselected depth and covered by a layer of uncooked dough surrounding said filler food and having a top portion with a preselected nominal thickness between an upper undulating surface and a generally flat lower surface and said appliance comprising:

(a) as a first component, a dish shaped receptacle formed of a continuous sheet of metal foil material with a pie receiving cavity between a lower wall upon which said dough is supported and an upper peripheral rim with a preselected shape and spaced from said lower wall a distance slightly greater than said preselected depth and slightly less than the sum of said preselected depth and said preselected thickness whereby said filler food of said pie is within said cavity, but below said rim, and is shielded from direct microwave exposure by said metal foil, except for microwave energy passing through the top portion of said dough layer, whereby said undulating upper surface of said top portion is above said rim; and, (b) as a second component, a self-sustaining generally rigid microwave susceptor sheet with an outer shape generally matching said preselected shape of said rim, said susceptor sheet supported directly on said upper surface of the top portion of said dough layer and in parallel, heat conduction relationship with said upper undulating surface but spaced from said rim by said top portion of said dough layer, said susceptor sheet including a thin metallized layer on a plastic film laminated to a paper board with a thickness less than 0.2 cm. with said layer having a thickness allowing microwave heating of said thin metal layer to brown said top surface into a browned, crisp crust by conduction to a temperature over 200° F. as said filler food is heated by only that microwave energy passing through said susceptor sheet and said top portion of said dough layer.

2. The combination as defined in claim 1 wherein said metallized layer is an evaporated layer of metal allowing microwaves to penetrate said upper surface of dough and said metallized layer including a uniform pattern of areas on said film without said evaporated metal with the total of said non-metal areas being controlled to produce a selected degree of browning.

3. The combination as defined in claim 1 wherein said second component is a generally flat susceptor sheet.

4. The combination as defined in claim 1 wherein said second component comprises a tent-shaped, self-sustaining generally rigid microwave susceptor sheet supported by gravity on said upper surface.

5. A method of reconstituting a frozen pie formed from a precooked, lossy material filler food having a preselected depth and surrounded by a layer of uncooked dough having a top portion with a preselected nominal thickness between an upper undulating surface and a generally flat lower surface, said method comprising the steps of:

(a) passing microwave energy for a preselected time through a layer of vacuum vaporized metal on a plastic film supported by gravity on said upper surface, then through said top portion and then, in succession, into said filler food whereby said filler food is heated essentially by only microwave energy passing through said metal layer and said top portion of said dough;

(b) during said preselected time, shielding said filler food from other microwave energy with a metal foil surrounding said dough, except at said top portion and, (c) selecting the thickness of said layer of vaporized metal to brown said upper surface as said filler food and dough layer are heated in unison by microwave absorption to final bake said dough layer and to heat said filler food to a preselected serving temperature.

6. A method of reconstituting a frozen pie formed from a precooked, lossy material filler food having a preselected depth and surrounded by a layer of uncooked dough with a top portion having a preselected nominal thickness between an upper undulating surface and a generally flat lower surface, said method comprising the steps of:

(a) passing microwave energy for a preselected time through said top portion and into said filler food while shielding said filler food from other microwave energy for said preselected time during which said filler food is heated and said dough is baked;

(b) then, placing on said upper surface a thin self-sustaining, microwave heatable susceptor sheet; and, (c) passing microwave energy through said susceptor sheet for a second time necessary to brown said upper surface while allowing microwave energy pass through said dough layer into said shielded filler food while said shielding is maintained.

* * * * *